United States Patent [19]

Scott

[11] Patent Number: 4,538,310

[45] Date of Patent: Sep. 3, 1985

[54] APPARATUS FOR COMFORTING AN INFANT

[76] Inventor: Norma J. Scott, 4510 W. Hope St., Milwaukee, Wis. 53216

[21] Appl. No.: 472,598

[22] Filed: Mar. 7, 1983

[51] Int. Cl.[3] ..... A47G 9/00

[52] U.S. Cl. ..... 5/437; 5/432

[58] Field of Search ..... 5/432, 434, 437; 46/162, 163, 173, 264, 265; 3/12.4, 12.5

[56] References Cited

U.S. PATENT DOCUMENTS

| | | | |
|---|---|---|---|
| 2,285,472 | 6/1942 | Tenenbaum | 46/162 |
| 2,881,559 | 4/1959 | Glass | 46/163 |
| 2,931,135 | 4/1960 | Zalkind | 46/163 |
| 2,961,668 | 11/1960 | Hayes | 5/434 |
| 3,566,537 | 3/1971 | Tepper et al. | 46/265 |
| 3,840,916 | 10/1974 | Jennings | 5/432 |
| 4,197,604 | 4/1980 | Nakamura | 5/437 |

*Primary Examiner*—Gary L. Smith
*Assistant Examiner*—Michael F. Trettel
*Attorney, Agent, or Firm*—Andrus, Sceales, Starke & Sawall

[57] ABSTRACT

An apparatus for comforting an infant. The apparatus includes a body portion which carries a pair of arms that are movable from an open position to a closed position where the arms can embrace an infant. A mechanism is incorporated in at least one of the arms which provides the arm with a patting type of movement which simulates a mother's embrace and acts to reassure and comfort the infant.

3 Claims, 5 Drawing Figures

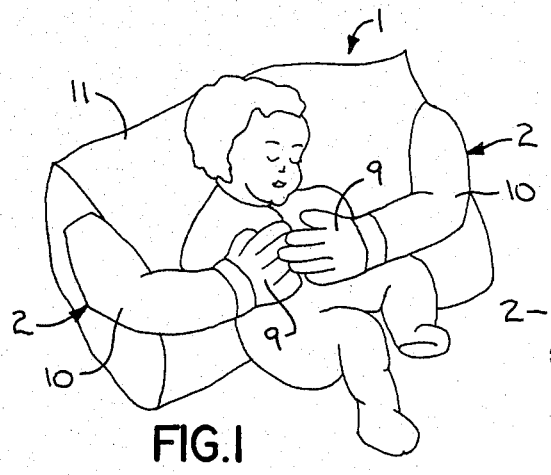
FIG.1
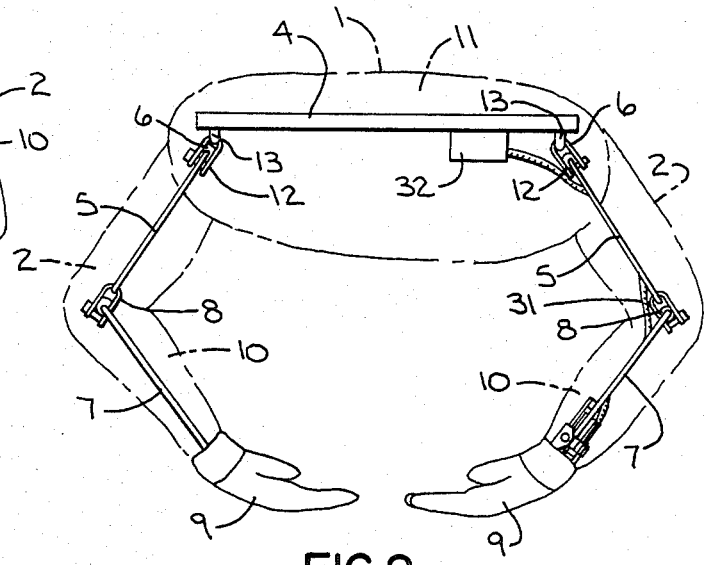
FIG.2
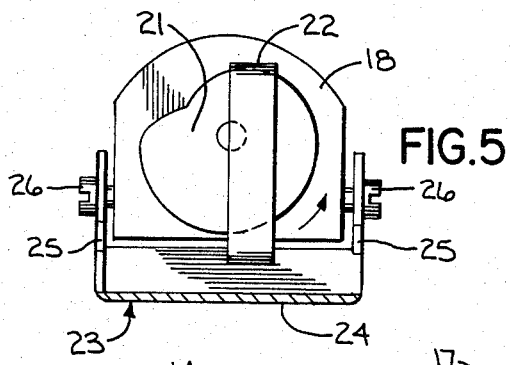
FIG.5
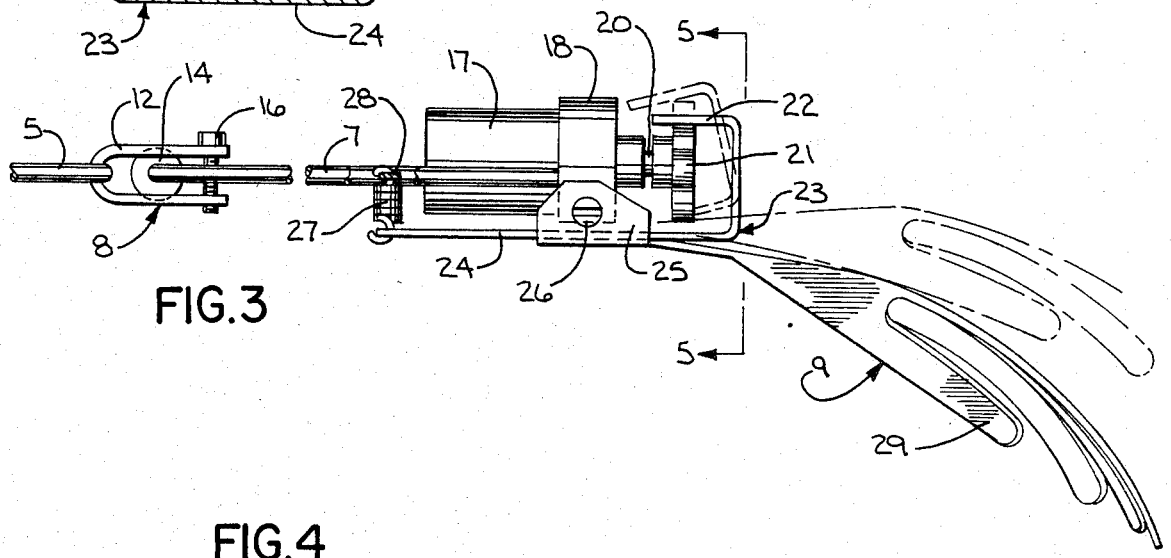
FIG.3
FIG.4
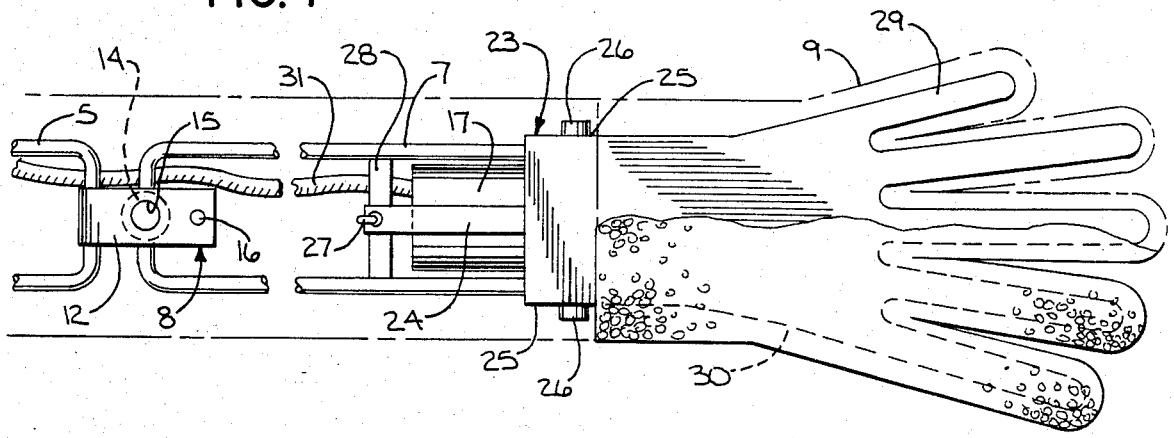

APPARATUS FOR COMFORTING AN INFANT

BACKGROUND OF THE INVENTION

It is well established that an infant is comforted by being embraced in the arms of a mother, nurse or other attendant, and a patting motion is particularly comforting to the infant. However, due to time constraints a mother, or other attendant cannot give full attention to an infant. Therefore there has been a need for a device which will simulate a mother's embrace.

SUMMARY OF THE INVENTION

The invention is directed to a device for comforting an infant by simulating a mother's embrace. The device includes a body portion or support and a pair of arms are carried by the body portion and are movable from an open position to a closed position where the arms will embrace an infant. A mechanism is incorporated with at least one of the arms which provides the arm with a reciprocating type of patting movement which will simulate a mother's embrace and soothe and reassure the infant.

In use, the infant is placed against the body portion and the arms are wrapped inwardly around the infant with the hands being either adjacent or in overlapping relation on the chest or stomach of the infant. Through power operation of the movable arm, the hand associated with that arm will move in and out toward the infant to provide a patting type of motion.

The device can be used in many different environments where it is desirable to soothe or comfort an infant such as the home, hospital, nursery, automobile, or the like.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the device of the invention shown embracing an infant;

FIG. 2 is a top plan view of the device showing the movable arms;

FIG. 3 is a longitudinal section showing the mechanism for moving one of the arms;

FIG. 4 is a top view of the mechanism shown in FIG. 3;

FIG. 5 is a section taken along line 5—5 of FIG. 3.

DESCRIPTION OF THE ILLUSTRATED EMBODIMENT

FIG. 1 illustrates a device for comforting or pacifying an infant which includes a cushioned support or body portion 1 and a pair of arms 2 are attached to the body portion and can be moved between an open position and a closed position where they will embrace a child or infant 3.

As best illustrated in FIG. 2, a generally rigid base or support 4 is located within the body portion 1 and a pair of inner arm sections 5 are connected to support 4 through universal joints 6, while outer arm sections 7 are connected to the outer end of each inner arm section 5 by universal joints 8. A hand 9 is attached to the outer end of each arm section 7.

As best illustrated in FIGS. 1 and 2, soft padding material 10 surrounds each of the arm sections 5 and 7 and similarly, the body portion 1 is provided with an outer layer of padding 11.

The joints 6 and 8 are constructed in a similar manner and provide substantial universal movement for arms 2. As the joints are of similar construction, only one joint 6 will be described in detail and it will be assumed that the other joints are constructed in a similar manner.

Joint 6 includes a clevis 12 which is connected to a lug 13 on one end of base 4 and a ball 14 is mounted within sockets 15 in opposite legs of the clevis 12. Bolt 16 connects the free ends of the clevis, and by tightening the bolt, the frictional resistance of the joint can be adjusted. With this construction, the inner arm sections 5 can be moved in a relatively universal manner with respect to base 4, and the outer arm sections 7 can be moved in a similar manner with respect to inner arm sections 5. With the arms in an open position, the infant can be placed against the body portion 1 and the arms can then be moved inwardly to embrace the infant, as shown in FIG. 1.

In accordance with the invention, a mechanism is utilized to provide a gentle patting motion for one or both of the arms 2. In this regard an electric motor 17 having a mounting collar 18 is attached to the side members of one of the outer arm sections 7, as illustrated in FIGS. 3 and 4. Motor 17 has a drive shaft 20 which is operably connected to cam 21, and a cam follower 22 carried by bracket 23 is adapted to ride against the outer surface of cam 21 as the cam rotates.

As shown in FIGS. 4 and 5, bracket 23 includes a base 24 and a pair of upstanding side flanges 25 extend upwardly from base 24 and are pivotally connected by pivots 26 to mounting collar 18. This pivotal connection permits the bracket 23 to pivot relative to the arm as follower 22 rides along the surface of cam 21.

Foller 22 is biased in a direction toward the cam surface by a spring 27 which is connected between the end of base 24 and a cross member 28 that extends between sides 19 of arm 7.

Bracket 23 is integrally connected to the rigid, finger-like core 29 of hand 9 and, as in the case of the body portion, a layer of padding 30 is applied over the core 29 of hand 9.

With the mechanism as described, rotation of cam 21 will move the hand 9 between the solid and phantom positions as shown in FIG. 3 to provide a gentle patting motion on the stomach or chest of the infant 3.

Motor 17 can be operated through leads 31 which are connected to a battery 32 mounted within body portion 1 and attached to base 4. A suitable "on-off" switch, not shown, can be associated with battery 32 and located on the outside of body portion 1. Alternately leads 31 can be connected directly to an electrical outlet in which case the battery would not be utilized.

While the above description has shown the mechanism for providing the patting motion as associated with only one of the arms 2, it is contemplated that in certain instances, a similar mechanism can also be associated with the other of the two arms 2.

The particular manner of providing the bendability of arms 2 is not critical to the invention. While the description has shown the use of the universal joints 6 and 8, it is contemplated that any desired construction can be utilized which will permit the arms to move between an open and a closed position. In the closed position in which the arms embrace the infant, the hands 9 can either be in an overlapping relation or can be located adjacent to each other.

In certain applications of use, the arms 2 can be associated with a fixed support, such as a crib as opposed to the cushioned body portion 1, illustrated in the drawings.

Various modes of carrying out the invention are contemplated as being within the scope of the following claims particularly pointing out and distinctly claiming the subject matter which is regarded as the invention.

I claim:

1. An apparatus for comforting an infant, comprising a support, a pair of arms pivotally connected to the support and movable between an open position and a closed position wherein said arms embrace an infant, each of said arms terminating in a hand portion, said hand portions being capable of being disposed in proximate relation when the arms are in the closed position, each arm comprises an inner arm section pivotally connected to said support and an outer arm section pivotally connected to the inner arm section, and drive means associated with at least one of said arms for moving said arm in a reciprocating path of travel toward and away from said support to thereby provide a gentle patting action for comforting said infant, said drive means includes a motor and a cam driven by said motor, said cam having an eccentric cam surface and said drive means including connecting means operably connecting said cam surface to said hand, whereby rotation of said cam will cause said hand to move in said reciprocating path.

2. The apparatus of claim 1, wherein said support comprises a padded cushion.

3. The apparatus of claim 1, wherein said drive means includes a self-contained power source mounted on said support.

* * * * *